US009080841B1

(12) United States Patent
Nechitailo

(10) Patent No.: US 9,080,841 B1
(45) Date of Patent: Jul. 14, 2015

(54) HYDRO-REACTIVE PROJECTILE FOR ENHANCED EXPLOSIVE DAMAGE

(71) Applicant: The United States of America, as represented by the Secretary of the Navy, Washington, DC (US)

(72) Inventor: Nicholas V. Nechitailo, King George, VA (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 13/921,376

(22) Filed: Jun. 19, 2013

(51) Int. Cl.

| | |
|---|---|
| ***F42B 12/36*** | (2006.01) |
| ***F42B 12/46*** | (2006.01) |
| ***F42B 12/76*** | (2006.01) |
| ***F42B 12/22*** | (2006.01) |
| ***F42B 12/34*** | (2006.01) |

(52) U.S. Cl.
CPC ..... *F42B 12/34* (2013.01); *F42B 12/22* (2013.01); *F42B 12/36* (2013.01); *F42B 12/367* (2013.01); *F42B 12/46* (2013.01); *F42B 12/76* (2013.01)

(58) Field of Classification Search
CPC ..... F42B 12/36; F42B 12/367; F42B 12/46; F42B 12/76; F42B 12/78; F42B 12/22; F42B 12/34
USPC ..... 102/293, 315, 326, 364, 365, 370, 477, 102/506, 513, 493, 501, 517
See application file for complete search history.

(56) References Cited

U.S. PATENT DOCUMENTS

| | | | | |
|---|---|---|---|---|
| 2,509,710 | A * | 5/1950 | Van Loenen | 102/365 |
| 2,884,836 | A * | 5/1959 | Allen | 175/3.5 |
| 2,923,243 | A * | 2/1960 | Crockford et al. | 102/512 |
| 4,280,409 | A * | 7/1981 | Rozner et al. | 102/364 |
| 4,372,213 | A * | 2/1983 | Rozner et al. | 102/301 |
| 5,212,343 | A * | 5/1993 | Brupbacher et al. | 102/323 |
| 8,250,981 | B1 * | 8/2012 | Gotzmer et al. | 102/314 |
| 8,387,535 | B1 * | 3/2013 | Guirguis et al. | 102/315 |
| 8,912,423 | B1 * | 12/2014 | Gotzmer et al. | 114/22 |

* cited by examiner

*Primary Examiner* — James S Bergin
(74) *Attorney, Agent, or Firm* — Gerhard W. Thielman, Esq.

(57) ABSTRACT

A hydro-reactive projectile is provided for striking a target. The projectile includes a housing composed substantially of aluminum and having a peripheral surface; and at least one cavity within said housing and a plurality of conduits connecting said cavity to said surface, wherein the cavity contains water.

3 Claims, 1 Drawing Sheet

HYDRO-REACTIVE PROJECTILE FOR ENHANCED EXPLOSIVE DAMAGE

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to hydro-reactive projectiles that incorporate a metal housing containing chemically stable liquid or other deformable medium for enhanced destructive effect. In particular, the invention includes an aluminum round having cavities filled with water.

Conventional inert projectiles represent a desired goal in the armed forces due to safety considerations, especially during storage and firing. However, such designs typically yield relatively low levels of destructivity unless accelerated to hypersonic velocities to impart significant kinetic energy to a target. Preferred conventional projectiles against hard targets are composed of high density materials, such as steel, tungsten, tungsten-carbide and depleted uranium. Such projectiles defeat targets by penetration, and in some cases by fragmentation. A conventional inert projectile striking a large shock-absorbing media, e.g., sand (that would protect the target) would have little effect besides displacement of some granular material.

SUMMARY

Conventional inert projectiles yield disadvantages addressed by various exemplary embodiments of the present invention. In particular, various exemplary embodiments provide a hydro-reactive projectile for striking a target. The projectile includes a housing composed substantially of aluminum and having a peripheral surface; and at least one cavity within said housing and a plurality of conduits connecting said cavity to said surface, wherein the cavity contains water.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

Figure 1A:
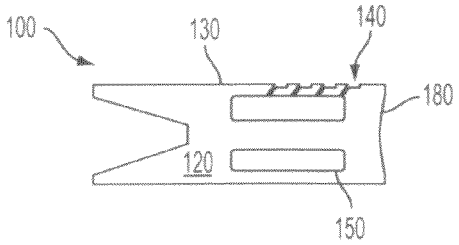
FIGS. 1A through 1C are cross-section views of a hydro-reactive projectile.

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

As a consequence of recent discovery by the inventor, various exemplary embodiments introduce hydro-reactive projectiles. These devices include a reacting material contained within and expelled from a case housing that serves to provide the projectile's structural integrity. Upon impact against a hard target, a projectile made of a hydro-reactive material, such as aluminum, reacting with a hydrogen-containing material, such as water, causes significantly enhanced destructive effects. In experiments conducted in Dahlgren, Va. at the Naval Surface Warfare Center-Dahlgren Division (NSWCDD), high-speed projectile impact has been observed and photographed using high-speed video-cameras. The results reveal several unexpected and strong damaging effects including an unexpected large fireball and a large amount of target material, including sand, and target components being ejected and propelled unusually large distances.

Exemplary embodiments are based on the above-described phenomenon. The exemplary munitions include projectile body made of a hydro-reactive material and a chemically stable liquid, granules or powder rich in oxygen and hydrogen placed inside of the projectile. In particular, exemplary embodiments provide an aluminum round with cavities filled with water. Upon impact, these projectiles react with water to generate hydrogen gas. Subsequent detonation of hydrogen produced powerful fireball and blast.

These experiments suggest the possibility of damage to nearby electronics from generated by the projectile reaction electro-magnetic and nuclear pulses. This disclosure explains recently discovered phenomenon of hydrothermal reactivity upon impact and describes various exemplary embodiments describes of hydro-reactive projectiles.

Blast energy released by chemical reaction of explosives transforms into several different types of energy including mechanical, thermal and electromagnetic. Mechanical energy can be related to pressure from gas expansion and/or solid fragment dispersal. Thermal effects include sharp increases in temperature that can lead to combustive ignition. Electromagnetic energy can be transmitted at various wavelengths, including microwave, infrared, visible and ultraviolet light.

At close proximity to the blast, electro-magnetic pulse can be sensed by various electric and electronic devices. Several tests at China Lake, Calif. have been observed on cased munitions at Naval Air Warfare Center-Weapons Division (NAWCWD) and noticed that pressure gauges placed at close proximity to the blast source registered peculiar transient spikes that had not been anticipated.

Several publications also mention strange spikes in data recording voltage signals measured close to the explosion source. Some authors interpret these spikes as increase in pressure and some authors doubt that the increase can be so significant. The applicant has interpreted these spikes in electric signals registered by electric/electronic sensors as purely electromagnetic effects (not actual air blast pressure) caused by other types of impulses such as electromagnetic pulse or nuclear radiation.

The projectiles used in these impact tests have often been frangible, with a blunt nose having a concave axisymmetric indentation at the tip to induce spall of the leading portion and progressive fracturing of the remainder of the projectile. Frangible disintegration produces large surfaces of exposed unoxidized aluminum. Moreover, friction interaction from scouring or scrubbing of the projectile's external oxidized aluminum surfaces removes aluminum oxides and facilitates reaction of aluminum with water.

High-speed impact into sand and soil induces spall and fracture of the aluminum projectile, thereby producing a large number of flake-shaped bare aluminum fragments. Projectiles launched in dry sand structurally disintegrated in numerous flake and disk-shaped fragments and caused damage to a localized impacted volume of sand as hot pulverized sand. Target damage was dramatically enhanced by introduction of water in the sand to chemically react with the aluminum and produce hydrogen gas and causing its detonation.

As an alternative the projectile can comprise a bundle of aluminum tubes that each contains water and encased in an external housing. Upon impact with a target, the housing and tubes collapse by buckling, and heat releases from the impact friction and the aluminum tubes reacting with the water.

Exemplary embodiments describe a hydro-reactive projectile for a caliber able to launch a projectile of about 3.0 kg±0.5 kg composed of aluminum and containing water within internal cavities. Channels connecting the external periphery of the projectile to the cavities enable the water contained therein to vent outward upon impact with a target. The projectile's outer periphery can be scored with indentations to facilitate fragmentation, and the channels can be sealed with a plug to prevent premature water leakage. Upon impact with a ground target, such as sand, the friction from impact and burial removes the aluminum oxide from the projectile's periphery, while the water ejects, reacts with the aluminum to enhance damage in response to the elevated temperature from the impact friction.

The aluminum reacts to the water by the following relation:

$$2Al+6H_2O \rightarrow 2Al(OH)_3+3H_2, \quad (1)$$

in which Al is aluminum, $H_2O$ is water, $Al(OH)_3$ is aluminum hydroxide and $H_2$ is gaseous hydrogen. This reaction thus produces aluminum hydroxide and hydrogen gas. Additional oxygen can be introduced by replacing pure water with a hydrogen peroxide ($H_2O_2$) solution.

According to V. M. Ivchenko et al., *Optimal Hydro jet Propulsion Systems* (1985), thermo-chemical energy released by 1 kg of powdered aluminum in water releases thermal energy equivalent to kinetic energy a 1 kg aluminum projectile moving at 5.9 km/s. The projectile, composed of solid aluminum would disintegrate into many disk-shaped fragments, portions of which can then react with the water. Total oxygen bond disassociation energy in water is 917.8 kJ/mol, so that about 2.7 MJ of energy is required to disassociate three moles or 54 grams of water $H_2O$. Unreacted fragments would be propelled with expanding gasses leading to additional fragment damage to the target.

Figure 1B:
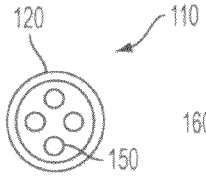
Figure 1C:
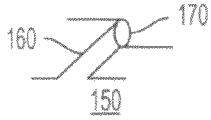

FIGS. 1A and 1B provide respective cross-section axisymmetric and axial-cutaway views 100 and 110 of an exemplary geometry is provided for the projectile 120. An outer periphery 130 includes scoring 140. Chambers 150 can be produced by mold castings of the housing for the projectile 120. FIG. 1C shows narrow conduits or channels 160 that can then be sealed by plugs 170. The forward end of the periphery 130 exhibits a concave blunt nose 180.

Exemplary embodiments provide for a substantially axisymmetric form, although bilateral symmetry can be employed for select launcher configurations. Depending on design constraints, the projectile 120 could typically be a few inches in length, as a three kilogram projectile could be approximated by a cube about 10 cm on each side. For a cavity containing 54 grams of water, this could be contained within 54 $cm^3$ or about five percent of the projectile volume.

Figure 2A:
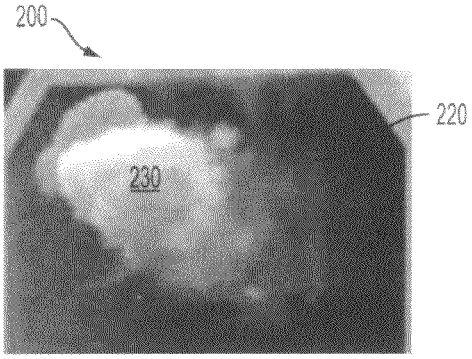
FIGS. 2A and 2B are images from tests in which a projectile was launched into a sand box.
Figure 2B:
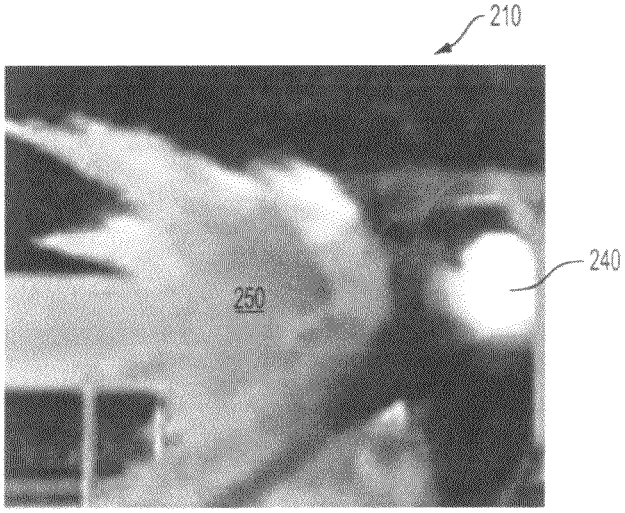

The destructive capability of the exemplary configuration is exemplified by a test with 5-to-10 MJ firings of a hydro-reactive projectile in which the projectile velocity was between 1.5 km/s and 2.5 km/s. FIGS. 2A and 2B provide respective example illustrations 200 and 210 of the effect of the projectile. The illustration 200 shows the projectile firing into a first box 220 filled with dry sand and exhibits a small cloud of dust 230. The illustration 210 shows the projectile fired into a second box 240 filled with wet sand.

Projectile impact resulted in unexpected, strange overlapping images recorded by digital video-camera, in a powerful fireball with resulting explosive plume 250 and a significant amount of target material, including sand and target components such as metal plates covering the sand box being thrown unexpectedly large distances. This demonstrated several damaging effects including the explosion caused by hydro-reactive projectile.

Aluminum and aluminum alloys constitute the preferred materials for the projectile, and water the preferred liquid for storage therein. Aluminum has mechanical properties conducive to providing structural integrity of a component, and can also react after removal of the surface's aluminum oxide coating.

Alternatively, other metals having oxidizing reactivity can be considered for containment in the cavity, such as magnesium, sodium, potassium and lithium. For example, $$Mg+2H_2O \rightarrow Mg(OH)+H_2, \quad (2)$$

in which Mg is magnesium. Thermo-chemical reactions can be further enhanced by adding hydro-reactive metals in the shapes with relatively high surface area ratios (e.g., fine wires, flakes, granules and particles).

By adding sodium (or potassium), the amount of released hydrogen can be controlled as follows:

$$Al_2O_3.nH_2O+2NaOH \rightarrow 2NaAlO_2+(n+1)H_2O, \quad (3)$$

in which Na is sodium and n represents an integer. This hydrogen-release relation is described by J. M. Olivares-Ramirez et al. in "Hydrogen Generation by Treatment of Aluminum Metal with Aqueous Solutions: Procedures and Uses" (Chapter 3), §2.2, available at http://cdn.intechopen.com/pdfs/40232/InTech-Hydrogen_generation_by_treatment_of_aluminium_metal_with_aqueous_solutions_procedures_and_uses.pdf. Gallium and indium additives can enhance the aluminum-water reaction. Moreover, aluminum-based composites, generally containing aluminum at 80 wt %, doped with zinc or tin and obtained by co-melting of the metallic components, can also be used. Such materials can be added in the form of flakes, wires and/or powder, embedded within the cavity to be expelled from aluminum structure upon target impact. An emulsifier, such as water, can also be included as a medium to form a gel or slurry within the cavity.

Alternatives to water filler placed inside of the projectiles include other hydrogen-rich materials such as hydrogen peroxide and hydrocarbons. J. L. Sabourin et al., "Combustion characteristics of nanoaluminum, liquid water, and hydrogen peroxide mixtures", *Combustion and Flame,* 154 (2008) 587-600, available at http://www.dtic.mil/dtic/tr/fulltext/u2/a546979.pdf, describes combustion and thermal aspects of nano-aluminum (particle size, 38 nm) in mixtures of liquid water and hydrogen peroxide.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. A hydro-reactive projectile for striking a target, said projectile comprising:

a housing composed substantially of aluminum and having a peripheral surface, said surface having indented scoring to produce indentations that induce fragmentation of said housing upon mechanical contact with the target; and at least one cavity within said housing and a plurality of conduits connecting said cavity to said surface, wherein said cavity contains an expellable material that releases upon said mechanical contact with the target and reacts with said aluminum to produce hydrogen.

2. The projectile according to claim 1, wherein said expellable material is water.

3. The projectile according to claim 1, wherein each said conduit is sealed with a removable plug.

* * * * *